US006330871B1

(12) United States Patent
Jufuku et al.

(10) Patent No.: US 6,330,871 B1
(45) Date of Patent: Dec. 18, 2001

(54) CYLINDER HEAD-INTEGRATED CYLINDER BLOCK AND PROCESS FOR MANUFACTURING THE SAME

(75) Inventors: Yasunobu Jufuku, Gotenba; Makoto Ueno, Mishima; Akihiko Hirooka, Susono; Yasuo Imai, Toyota; Tatsumi Furukubo, Gotenba, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/552,154

(22) Filed: Apr. 18, 2000

(30) Foreign Application Priority Data

Apr. 21, 1999 (JP) ..... 11-114244
Dec. 3, 1999 (JP) ..... 11-345556

(51) Int. Cl.[7] ..... F02F 1/00; F02F 1/24; F02F 7/00; F02F 11/00

(52) U.S. Cl. ..... 123/193.3

(58) Field of Search ..... 123/193.3, 193.5, 123/193.2

(56) References Cited

U.S. PATENT DOCUMENTS

| | | | | |
|---|---|---|---|---|
| 3,744,462 | * | 7/1973 | Herschmann et al. | 123/41.31 |
| 4,630,345 | * | 12/1986 | Lutz | 123/193.3 |
| 4,791,896 | * | 12/1988 | Bidwell | 123/193.5 |
| 4,938,183 | * | 7/1990 | Dield et al. | 123/193.3 |
| 5,033,427 | * | 7/1991 | Kawamura et al. | 123/193.3 |
| 5,730,096 | * | 3/1998 | Atmur et al. | 123/193.5 |
| 6,073,595 | * | 6/2000 | Brogden | 123/193.3 |

FOREIGN PATENT DOCUMENTS

| | | |
|---|---|---|
| 6032536 U | 3/1985 | (JP) . |
| 60159857 U | 10/1985 | (JP) . |
| 6355349A | 3/1988 | (JP) . |
| 526100A | 2/1993 | (JP) . |

OTHER PUBLICATIONS

Lecture Dissertations of Japan Machine Society (held on Sep. 4, 1998 in Toyama, Japan), "Development of All Aluminum Cylinder Block with Powder Metallurgy Composites Liners", Tomoo Oka et al. (pp. 17–20).

* cited by examiner

*Primary Examiner*—Marguerite McMahon
(74) *Attorney, Agent, or Firm*—Kenyon & Kenyon

(57) ABSTRACT

The present invention provides a cylinder head-integrated cylinder block in which assembly is easy and a thickness of an aluminum member is not increased even if an integral cylinder head is molded by using the aluminum member and which is lightweight and has strength at a high temperature and a process for manufacturing the cylinder head-integrated cylinder block. A cylindrical cup-shaped member with a bottom is molded of reinforced aluminum material having heat resistance and wear resistance, a cylinder head portion and a cylinder block portion are molded as an integral body by molding the molded cup-shaped member in casting aluminum material by enveloped casting, and the cylinder block portion in which the cup-shaped member is molded by enveloped casting is pressurized under a condition of a temperature at which a material characteristic of the reinforced aluminum material constituting the cup-shaped member does not change, thereby providing a cylinder head-integrated cylinder block in which the cylinder head portion having an intake port and an exhaust port and the cylinder block portion whose end face opening is closed by the cylinder head portion are integrated.

9 Claims, 16 Drawing Sheets

(a)

(b)

(c)

(a)

(b)

CYLINDER HEAD-INTEGRATED CYLINDER BLOCK AND PROCESS FOR MANUFACTURING THE SAME

BACKGROUND OF THE INVENTION

1. Field of the Invention

The present invention relates to a cylinder block of an internal combustion engine integrally having a cylinder head and particularly to a cylinder head-integrated cylinder block having liner portions of cylinders made of reinforced aluminum members with heat resistance and wear resistance and a process for manufacturing the cylinder head-integrated cylinder block.

2. Prior Art

In a conventional internal combustion engine, a cylinder head is fastened to a cylinder block through cylinder head bolts and a gasket is provided between the cylinder head and the cylinder block to seal in combustion gas. In this structure, because the cylinder head bolts receive force of expansion caused by combustion, there is a possibility that sealing in of gas cannot be ensured if fastening force of the cylinder head bolts decreases. When rigidity of the cylinder block is not ensured, stress generated in the cylinder block in fastening may cause deformation of liners against which pistons slide. Furthermore, the number of parts is large, which increases the volume of work in assembly.

Because the above problems were caused by separate structures of the cylinder head and the cylinder block in the internal combustion engine, an internal combustion engine having an integral cylinder head-cylinder block structure was proposed in recent years.

There is an integrally-molded engine having an integral cylinder head-cylinder block structure by using cast iron as disclosed in Japanese Utility Model Application Laid-open No. 60-159857, for example. As material for a casting structure, material using casting aluminum which is lightweight and has cooling effect is known in addition to cast iron.

There is one in which cylinder liners in a cylinder block are formed as separate bodies and are coupled to a lower portion of a cylinder head to form an integral structure as disclosed in Japanese Patent Application Laid-open No. 5-26100. The invention of Japanese Patent Application Laid-open No. 5-26100 prevents deformation of the cylinder liners by fitting lower ends of the cylinder liners projecting from the lower end of the cylinder head into a recessed portion of the cylinder block.

Moreover, in the conventional internal combustion engine with the integral structure, dry liners having wear-resistant inner peripheral faces are inserted into cylinder barrels or inner peripheral faces of the cylinder barrels are directly chrome plated.

The casting aluminum has a problem of insufficient strength at a high temperature and it is necessary to increase a thickness of a combustion chamber portion which receives combustion pressure under a high temperature condition in the internal combustion engine using the casting aluminum. However, in a case of making a device of Japanese Utility Model Application Laid-open No. 60-159857 by using the casting aluminum, weight increases because the thickness of an inner wall of the combustion chamber portion is necessary to be increased for insuring strength in the conventional internal combustion engine.

Although the invention of Japanese Patent Application Laid-open No. 5-26100 has a structure for making up the insufficiency of the strength of the liners, the invention does not solve the insufficient strength at the high temperature at its source. Therefore, it is necessary to increase the thickness of the inner wall of the combustion chamber portion to insure the strength, thereby increasing weight.

Furthermore, if the wear-resistant dry liners are inserted through inner peripheral faces of the cylinder-barrels or the inner peripheral faces are directly chrome plated, the number of parts increases, which increases the volume of work in assembly.

SUMMARY OF THE INVENTION

The present invention has been accomplished with the above problems in view, and it is an object of the invention to provide a cylinder head-integrated cylinder block which is easy to assemble, lightweight and has strength at a high temperature without increasing a thickness of the aluminum member even if an integral cylinder head is molded by using an aluminum member and a process for manufacturing the cylinder head-integrated cylinder block.

To achieve the above object, the invention employs the following means.

In other words, a cylinder block of the invention is a cylinder head-integrated cylinder block in which a cylinder head portion having an intake port and an exhaust port and a cylinder block portion whose end face opening is closed by the cylinder head portion are molded integrally by casting.

The cylinder block includes a cylindrical cup-shaped member having a bottom and a surrounding member in which the cup-shaped member is wrapped.

The cup-shaped member forms a head inner wall portion forming a combustion chamber and a liner portion which is adjacent to the head inner wall portion and against which a piston can slides. The cup-shaped member is integrally molded of reinforced aluminum members having heat resistance and wear resistance. The surrounding member is formed of a casting aluminum member and the cup-shaped member is molded in the surrounding member by enveloped casting.

According to the invention, because the head inner wall portion and the liner portion constituting the cup-shaped member are molded integrally of the reinforced aluminum member and the cup-shaped member is molded in the casting aluminum member by enveloped casting, a thickness of an inner wall can be reduced as compared with a case in which the cylinder head and the cylinder block are simply molded integrally by using the casting aluminum material by an aluminum casting method and weight can be reduced.

Because the cylindrical reinforced aluminum member which has the bottom and is the cup-shaped member is molded in the surrounding member by enveloped casting such that the cylinder head and the cylinder block are integrated, a gas seal such as a gasket is unnecessary and the number of parts can be decreased, thereby facilitating assembly.

Here, the reinforced aluminum member constituting the cup-shaped member may have different aluminum characteristics at the head inner wall portion and the liner portion.

For example, the head inner wall portion of the invention is molded of an aluminum forged member with a high-strength aluminum characteristic and the liner portion is molded of an aluminum forged member with a wear-resistant aluminum characteristic. In other words, different parts of the cylinder may have aluminum characteristics with different required performance. If at least the liner portion is made of the aluminum forged member with the wear-resistant aluminum characteristic, it is possible to reduce the thickness to a proper degree, thereby further facilitating weight reduction while providing high strength.

It is possible to provide the different characteristics to the different parts of an integral body, i.e., provide the high-strength aluminum characteristic to the head inner wall portion and the wear-resistant aluminum characteristic to the liner portion by changing a formula of metallic additives added to the aluminum material used for the respective parts. In this case, preparation can be carried out relatively easily by using aluminum powder. Needless to say, if the head inner wall portion and the liner portion are molded with equal formulas of the metallic additives, the characteristics of the reinforced aluminum members of the head inner wall portion and liner portion may be equalized with each other.

Furthermore, according to the invention, a corner portion where a bottom portion and an inner peripheral face portion at a periphery of the bottom portion of the cylindrical shape with the bottom of the head inner wall portion intersecting each other may be formed into an arc shape. With this structure, combustion pressure is received by the arc shape and it is possible to prevent combustion stress from concentrating on a point of the corner portion. Because the corner portion is formed into the arc shape and the integral cylindrical shape having the bottom is formed to include the bottom portion, inner peripheral face portion, and liner portion, a honing processing is easy.

According to the invention, it is also possible to form a projection and a depression on an outer wall face of the cylindrical cup-shaped member having the bottom and molded in the casting aluminum by enveloped casting, for example. With this structure, because the projection and depression are formed on the outer wall face of the cylindrical cup-shaped member having the bottom, it is possible to increase bonding strength of a phase boundary between aluminum and the reinforced aluminum member constituting the cylindrical cup-shaped member having the bottom in casting of aluminum.

Moreover, according to the invention, a protuberant portion made of the same reinforced aluminum member as that of the cup-shaped member is formed integrally to correspond to the exhaust port on a top wall face of the cylindrical cup-shaped member having the bottom and molded in the casting aluminum by enveloped casting and the exhaust port is formed to pass through the protuberant portion, thereby forming at least a portion of an inner wall of the exhaust port by using the reinforced aluminum member.

With this structure, because the top wall face is reinforced by the protuberant portion made of the reinforced aluminum member and an inner face portion of the exhaust port that receives the most combustion stress is formed of an aluminum forged member with the high-strength aluminum characteristic, fatigue strength can be further increased.

In the invention, the liner portion of the cylinder may have such an axial length as to allow the piston to slide to reciprocate between the combustion chamber side and a bottom dead center position, for example. With this structure, it is possible to sufficiently maintain airtightness of the combustion chamber.

The intake port and exhaust port are formed to pass through the cup-shaped member made of the reinforced aluminum member and the surrounding member which is made of the casting aluminum member in which the cup-shaped member is wrapped. A joint face (phase boundary) end portion between the cup-shaped member and the surrounding member at this portion is preferably covered with a seal member.

At other portions, it is preferable to cover an exposed joint face (phase boundary) end portion between the cup-shaped member and surrounding member with a seal member.

Next, a process for manufacturing a cylinder head-integrated cylinder block according to the invention will be described.

The process of the invention comprises the steps of molding a cylindrical cup-shaped member with a bottom of reinforced aluminum material having heat resistance and wear resistance, molding a cylinder head portion and a cylinder block portion as an integral body by molding the molded cup-shaped member in casting aluminum material by enveloped casting, and pressurizing the cylinder block portion in which the cup-shaped member is molded by enveloped casting under a condition of a temperature at which a material characteristic of the reinforced aluminum material constituting the cup-shaped member does not change.

Here, if a joint face end portion between the cup-shaped member and the casting aluminum material in which the cup-shaped member is molded by enveloped casting is welded before the pressurization, exfoliation at the joint face end portion due to pressurization can be prevented.

If the joint face end portion is welded, the welded joint face end portion is removed after the pressurization. For this removal, sizes of the cup-shaped member and a casting die are preferably set at slightly larger values in advance to allow for a size of the portion to be removed.

The joint face end portion after removing the welded portion is preferably covered with a seal member.

Then, if a thickness of the cup-shaped member is set at a value larger than a thickness of a final molded product by a predetermined value and an inner wall face of the cup-shaped member is removed until the final thickness is obtained after the pressure treatment, it is possible to carry out finishing with accurate dimensions as a whole.

It is also possible that a cup-shaped aluminum casting with a predetermined thickness is formed on an inside of the cup-shaped member, the cup-shaped member with the inside aluminum casting is molded in a surrounding member made of the casting aluminum material by enveloped casting such that the surrounding member is joined to an end portion of the inside aluminum casting at an opening portion of the cup-shaped member, and then, the pressure treatment is applied after welding the joined joint face end portion, and finally, the welded portion is removed, and an inner wall face of the cup-shaped member as well as the inside aluminum casting is removed until a final thickness is obtained.

If the cup-shaped aluminum casting is formed on the inside of the cup-shaped member and the cup-shaped member with the inside aluminum casting is molded in the surrounding member made of the casting aluminum material by enveloped casting, the inside aluminum casting cools the cup-shaped member and decreases a temperature of the liner portion in teeming of the surrounding member. Therefore, it is easy to maintain the required aluminum characteristic of the liner portion.

Furthermore, in the above process, the casting aluminum material covers the entire cup-shape member made of the reinforced material from inside and outside and especially, the casting aluminum material at an inside and an outside of the cup-shaped member is joined at the joint face end portion between the cup-shaped member and the surrounding member at the periphery of the cup-shaped member to protect the joint face end portion. Therefore, it is possible to further effectively prevent exfoliation of the joint face in the pressure treatment.

As a manufacturing process similar to the above process, the following process is also possible. If the cup-shaped member is assumed to be a first cup-shaped member, a second-cup shaped member which can be fitted with an inside of the first cup-shaped member is formed of the casting aluminum material, the first cup-shaped member is molded in a surrounding member made of the casting aluminum material by enveloped casting after press-fitting the second cup-shaped member with the inside of the first cup-shaped member such that the surrounding member is joined to an end portion of the second cup-shaped member at an opening portion of the first cup-shaped member, and then, the pressure treatment is applied after welding the joined joint face end portion, and finally, the welded portion is removed, and an inner wall face of the first cup-shaped member as well as the second cup-shaped member is removed until a final thickness is obtained.

In this case, similarly to the previous process, exfoliation of the joint face between the first cup-shaped member and the surrounding member in the pressure treatment can be prevented further effectively.

It is preferable to form a groove extending in an axial direction on at least one of an inner peripheral face of the first cup-shaped member and an outer peripheral face of the second cup-shaped member to vent air in the first cup-shaped member.

When the cylindrical cup-shaped member with the bottom is molded of the reinforced aluminum material having heat resistance and wear resistance and the cylinder head portion and the cylinder block portion are molded as the integral body by molding the molded cup-shaped member in the casting aluminum material by enveloped casting, the cup-shaped member is necessary to be set in a casting die for enveloped casting. At this time, positioning of the cup-shaped member in a direction of a rotation around a central axis of the cup-shaped member is necessary.

The reason for this is that a recessed portion corresponding to a hole for a valve is necessary to be formed in advance on the cup-shaped member, for example. This recessed portion is a portion where the hole for the valve is formed after molding.

As described above, it is preferable to form a positioning portion on an open end portion of the cup-shaped member for positioning of the cup-shaped member in the rotation direction in setting the cup-shaped member in the casting die.

As the positioning portion, there are a groove, a recessed portion, a projecting portion, and the like formed on the open end of the cup-shaped member, for example. When the cup-shaped member is set in the casting die, the cup-shaped member is rotated. It is preferable that an engaging portion on the casting die to be engaged with the positioning portion of the cup-shaped member such as an engaging projection to be engaged with the groove or the like on the cup-shaped member is detected physically or by a light sensor and the like thereby positioning the cup-shaped member with respect to the casting die and the cylinder block portion is molded by molding the cup-shaped member in the casting aluminum member by enveloped casting.

Although the manufacturing process by molding the cup-shaped member in the surrounding member by enveloped casting has been described above, it is also possible to employ a manufacturing process by fitting the cup-shaped member in the above surrounding member in addition to the above process.

In other words, a cylindrical cylinder block portion and a cylinder head portion which closes one opening end of the cylinder block portion are formed integrally by using casting aluminum material by casting. This corresponds to the above surrounding member. On the other hand, a cylindrical cup-shaped member having a bottom and made of reinforced aluminum material having heat resistance and wear resistance is prepared. The cup-shaped member is press-fitted from the other opening end of the cylinder block portion, and the cup-shaped member and the cylinder block portion which are integrated by the press-fitting are pressurized under a condition of a temperature at which a material characteristic of the reinforced aluminum material constituting the cup-shaped member does not change.

If a joint face end portion between the cup-shaped member and the casting aluminum material is welded before the pressurization, exfoliation of the joint face in the pressurization can be prevented.

If the welding is carried out, it is preferable that the welded joint face end portion is removed after the pressurization and that sizes of the cup-shaped member and the casting aluminum material are set at slightly larger values in advance to allow for a size of the portion to be removed.

If a thickness of the cup-shaped member is set at a value larger than a thickness of a final molded product by a predetermined value and an inner wall face of the cup-shaped member is removed until the final thickness is obtained after the pressure treatment, it is possible to carry out finishing with accurate dimensions.

When the cup-shaped member is press-fitted from the other opening end of the cylinder block portion, it is preferable to form a groove extending in a direction of a cylinder axis on at least one of an outer peripheral face of the cup-shaped member and an inner peripheral face of the cylinder block portion for venting air in the cylinder block portion.

The above respective structures can be combined with each other where possible.

BRIEF DESCRIPTION OF THE DRAWINGS

FIG. 2(*a*) shows a case in which grooves are formed and FIG. 2(*b*) shows a case in which a plurality of projecting portions are formed.

FIG. 3(*a*) is a vertical sectional view of the integral cylinder head, FIG. 3(*b*) is a plan view of a top wall of a cup-shaped forged portion, FIG. 3(*c*) is a perspective view of the top wall of the cup-shaped forged portion.

FIG. 4(*a*) is a vertical sectional view of the integral cylinder head and FIG. 4(*b*) is a plan view of a top wall of a cup-shaped forged portion.

DETAILED DESCRIPTION OF THE PREFERRED EMBODIMENT

Embodiments of a cylinder head-integrated cylinder block according to the present invention will be described below by reference to the drawings.

<Embodiment 1>

[A Structure of the Cylinder Head-integrated Cylinder Block]

First, a structure of the cylinder head-integrated cylinder block will be described based on a vertical sectional view of FIG. 1.

Figure 1:
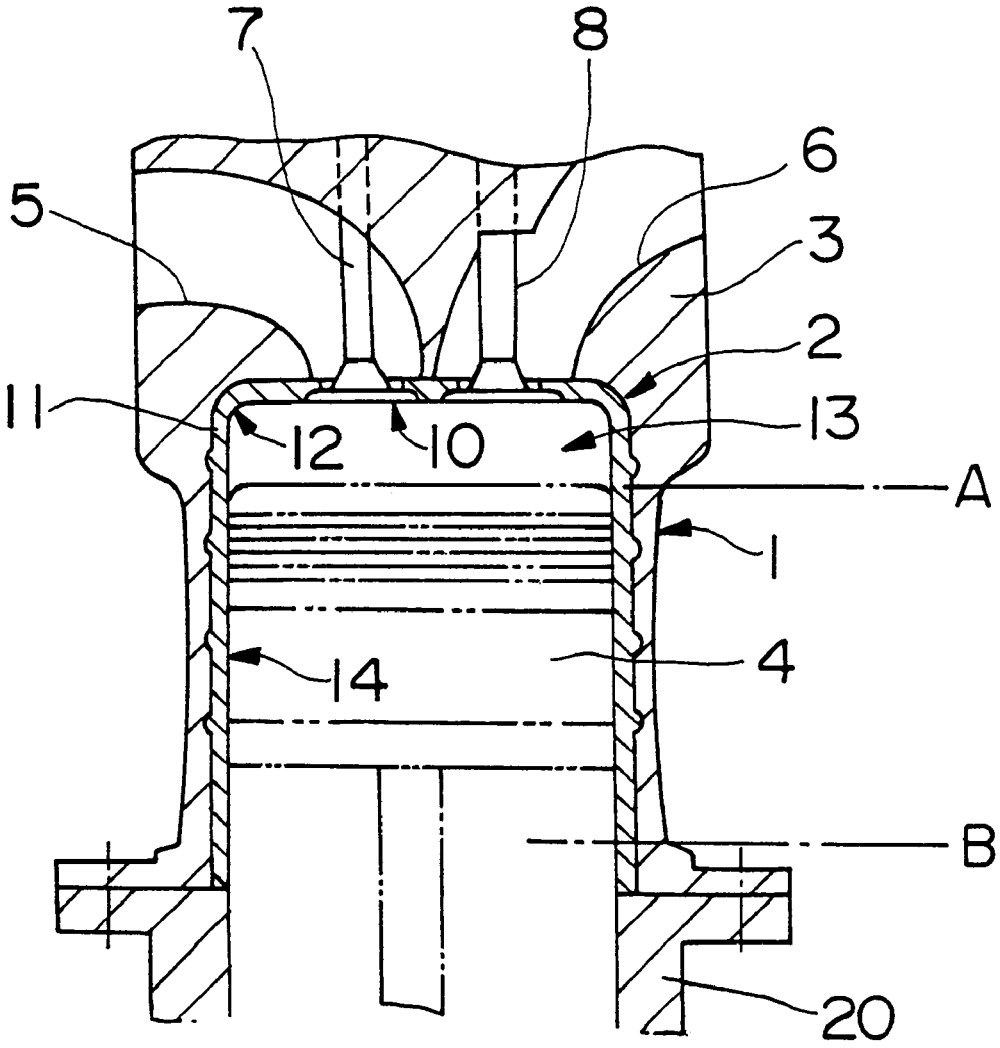
FIG. 1 is a vertical sectional view of an integral cylinder head according to an embodiment 1 of the present invention.

The cylinder head-integrated cylinder block 1 shown in FIG. 1 includes a cup-shaped cylindrical forged portion 2 (which is a cup-shaped member of the present invention and hereafter referred to as a cup-shaped forged portion) having a bottom and molded of an aluminum forged member that is a reinforced aluminum member and an aluminum forged portion 3 (which is a surrounding member of the invention and hereafter simply referred to as a forged portion) molded by molding the cup-shaped forged portion 2 in casting aluminum by enveloped casting.

The cup-shaped forged portion 2 is an integral body including a bottom portion 10 constituting a part of a combustion chamber 13, an inner peripheral face portion 11 (referred to as a side portion) around a periphery of the bottom portion, and a liner portion 14. The combustion chamber 13 is space surrounded by a top face of a piston 4, the bottom portion 10 of the above cup-shaped forged portion 2, and the side portion 11 when the piston 4 is at a top dead center position A.

In the cup-shaped forged portion 2, an arc (corner radius portion) 12 is molded at a corner portion where the bottom portion 10 intersects the side portion 11. The liner portion 14 has such a length as to allow the piston 4 to slide along the liner portion 14 to reach bottom dead center position B.

In the cup-shaped forged portion 2, because the bottom portion 10 and the side portion 11 which constitute the portion of the combustion chamber 13 are parts to receive combustion pressure under a high temperature condition, an aluminum forged member with a high-strength aluminum characteristic is used as material of the bottom portion 10 and the side portion 11. On the other hand, because the liner portion 14 against which the piston 4 slides is a part liable to be applied with friction due to sliding of the piston 4, an aluminum forged member with a wear-resistant aluminum characteristic is used as material of the liner portion 14. The cup-shaped forged portion 2 is integrally molded of the aluminum members by a forging method such that different parts of the cup-shaped forged portion 2 have different characteristics, i.e., the high-strength characteristic and wear-resistant characteristic. A difference between the aluminum forged member with the high-strength aluminum characteristic and the aluminum forged member with the wear-resistant aluminum characteristic is caused by a difference in a formula for mixing aluminum powder and metallic additives added to the aluminum powder.

Of course, by uniformalizing the formula for mixing the aluminum powder and the metallic additives, the bottom portion 10, the side portion 11, and the liner portion 14 have the same aluminum characteristic.

For example, there is an aluminum forged member with the high-strength aluminum characteristic prepared by adding a metallic additive such as a rare-earth metallic element (cerium, lanthanum, or the like), a transition element (zirconium, iron, nickel, or the like), and the like to the aluminum powder. The aluminum forged member is molded into a shape of a part by using a known powder forging device. There is an aluminum forged member with the wear-resistant aluminum characteristic prepared by adding silicon as a metallic additive of the rare-earth metallic element to the above aluminum forged member with the high-strength aluminum characteristic as a base, for example. This aluminum forged member is also molded into a shape of a part by using the known powder forging device.

Figure 2:
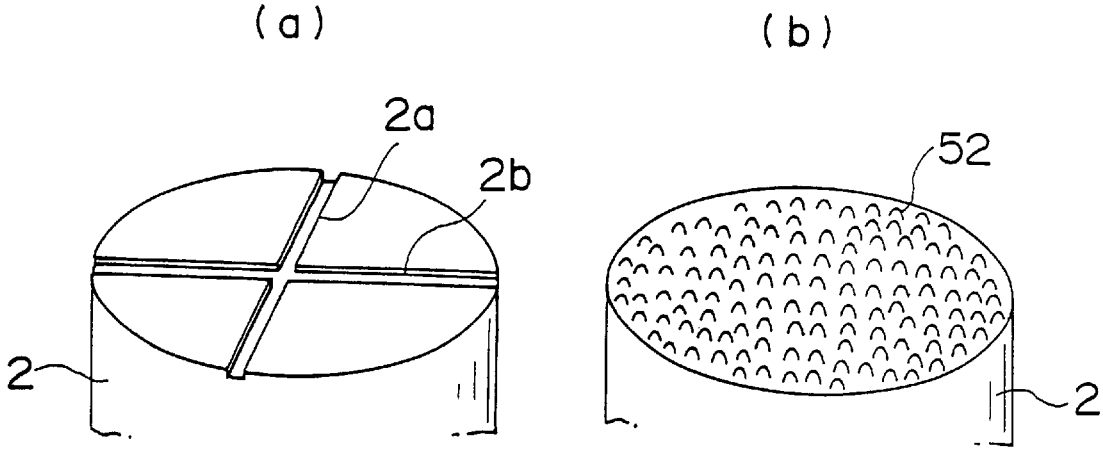
FIGS. 2(*a*) and 2(*b*) are perspective views of a top wall of a cup-shaped forged portion of the invention.

As shown in a perspective view in FIG. 2(*a*), a top portion of the cup-shaped forged portion 2 is formed with intersecting grooves 2*a* and 2*b*. The grooves 2*a* and 2*b* are provided for increasing bonding strength of a phase boundary in molding the cup-shaped forged portion 2 in the casting aluminum (casting portion 3).

On the casting portion 3 that is a surrounding member, a support portion of a valve operating system and the intake and exhaust ports are molded. In other words, as shown in FIG. 1, the casting portion 3 is formed with the intake port 5 for introducing fuel and fresh air into the combustion chamber 13 and the exhaust port 6 for exhausting combustion gas generated by combustion from the combustion chamber 13 by molding. An intake valve 7 is disposed for opening and closing at the intake port 5 while an exhaust valve 8 is disposed for opening and closing at the exhaust port 6.

The cylinder head-integrated cylinder block 1 is mounted onto a crankcase 20.

[Operation of the Cylinder Head-integrated Cylinder Block]

According to the present embodiment, because the bottom portion 10 and the side portion 11 of the cup-shaped forged portion 2 are made of the aluminum forged member with a high-strength aluminum characteristic, it is possible to decrease the wall thickness and the weight as compared with the cup-shaped casting portion molded by an aluminum casting method.

Moreover, because the liner portion 14 of the cup-shaped forged portion 2 is formed of the aluminum forged member with the wear-resistant aluminum characteristic, it is possible to decrease the thickness to a proper extent, provide high strength, and further reduce the weight.

Providing the high-strength aluminum characteristic to the bottom portion 10 and the side portion 11 of the cup-shaped forged portion 2 and the wear-resistant aluminum characteristic to the liner portion 14, i.e., providing the different characteristics to the different parts of the integral body can be achieved by changing the formula for adding the metallic additives to the aluminum material used for the respective parts. In this case, preparation is relatively easy if the aluminum powder is used.

Furthermore, integrally molding the cup-shaped forged portion 2 in the casting portion 3 by enveloped casting decreases the number of parts in assembly, let alone makes gas sealing unnecessary.

Moreover, according to the present embodiment, because the corner portion 12 formed by the inner periphery portion and the bottom portion of the cup-shaped forged portion 2 is molded to have the arc shape such that the arc shape receives the combustion pressure, it is possible to prevent combustion stress from concentrating on only a point of the corner portion 12. Because the corner portion 12 is molded to have the smooth arc shape and the cup-shaped forged portion 2 is molded integrally to have the bottom portion 10, the side portion 11, and the liner portion 14, honing is easy.

Furthermore, according to the present embodiment, because the intersecting grooves 2*a* and 2*b* are formed on the top wall face of the cup-shaped forged portion 2, it is possible to increase bonding strength of the phase boundary between the cup-shaped forged portion 2 and the casting portion 3 in the aluminum casting. Although the intersecting grooves 2*a* and 2*b* are formed on the top wall face of the cup-shaped forged portion 2 in the embodiment, the invention is not limited to the grooves 2*a* and 2*b*. Any projections and depressions formed on an outer wall face of the cup-shaped forged portion 2 to increase the bonding strength of the phase boundary are sufficient and a plurality of projecting portions 52 may be formed on the top wall face of the cup-shaped forged portion 2 as shown in FIG. 2(*b*).

According to the present embodiment, because the liner portion 14 of the cylinder has such an axial length as to allow the piston 4 to slide to reciprocate between the combustion chamber 13 side and the bottom dead center position B of the liner portion 14, it is possible to keep sufficient airtightness of the combustion chamber 13.

<Embodiment 2>

Next, another embodiment 2 of the cylinder head-integrated cylinder block according to the invention will be described on the basis of FIG. 3. A difference between the above-described embodiment 1 and another embodiment 2 is in a shape of the top wall face of the cup-shaped forged portion 2. While the top wall face in the above-described embodiment has a flat shape, a protuberant portion 30 (see FIG. 3(*a*)) is formed on the top wall face in another embodiment 2. If reference numerals or characters which are the same as those in FIG. 1 described in the above embodiment are used in FIG. 3, such reference numerals or characters designate portions having the same functions as those in FIG. 1 and detailed descriptions of such portions will be omitted.

Figure 3:
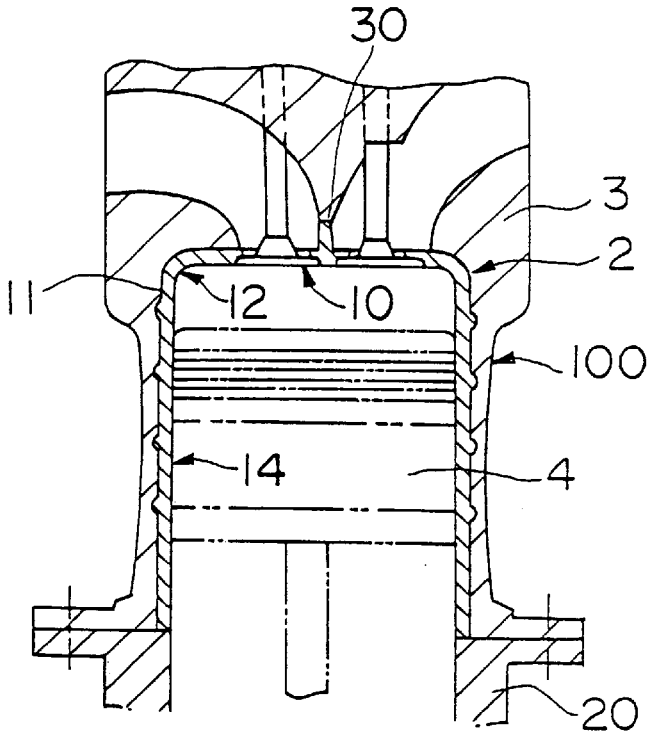
FIGS. 3(*a*) to 3(*c*) are explanatory views of an integral cylinder head according to an embodiment 2 of the invention.
Figure 3:
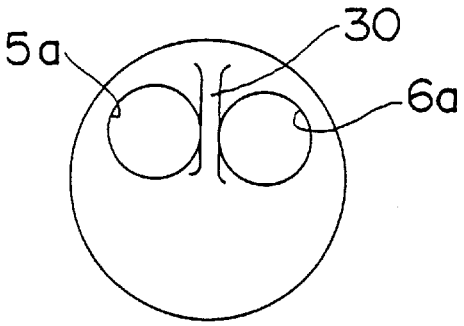
Figure 3:
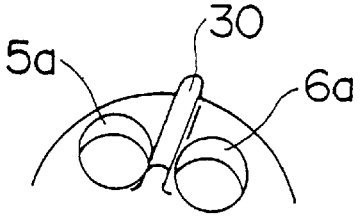

As shown in a plan view of the top wall face of FIG. 3(*b*) and a perspective view of the top wall face of FIG. 3(*c*), the cylinder head-integrated cylinder block 100 of the embodiment 2 has the linear protuberant portion 30 on the top wall face of the cup-shaped forged portion 2.

The protuberant portion 30 is formed to pass through between the intake system (the intake port 5 and the intake valve 7) and the exhaust system (the exhaust port 6 and the exhaust valve 8). The protuberant portion 30 is integrally molded with the cup-shaped forged portion 2 by using the aluminum forged member with the high-strength aluminum characteristic that is the same as the member used for the bottom portion 10 and the side portion 11 of the cup-shaped forged portion 2.

The cylinder head-integrated cylinder block 100 is molded by molding a periphery of the cup-shaped forged portion 2 having the protuberant portion 30 in the casting aluminum by enveloped casting.

According to another embodiment 2, because the linear protuberant portion 30 is formed on the top wall face of the cup-shaped forged portion 2, the top wall face between the intake system and the exhaust system is reinforced and fatigue strength is increased. Therefore, it is possible to reduce a thickness of the top wall face and weight in the embodiment 2.

<Embodiment 3>

Next, the embodiment 3 of the cylinder head-integrated cylinder block of the internal combustion engine according to the invention will be described based on FIG. 4. A difference between the embodiment 2 and the other embodiment 3 is in the projecting shape formed on the top wall face of the cup-shaped forged portion 2. Although the linear protuberant portion 30 is formed in another embodiment 2, a protuberant portion 40 (see FIG. 4(*a*)) surrounding an opening hole 6*a* of the exhaust port 6 is formed in the other embodiment 3. If reference numerals or characters which are the same as those in FIG. 1 described in the above embodiment are used in FIG. 4, such reference numerals or characters designate portions having the same functions as those in FIG. 1 and detailed descriptions of such portions will be omitted.

Figure 4:
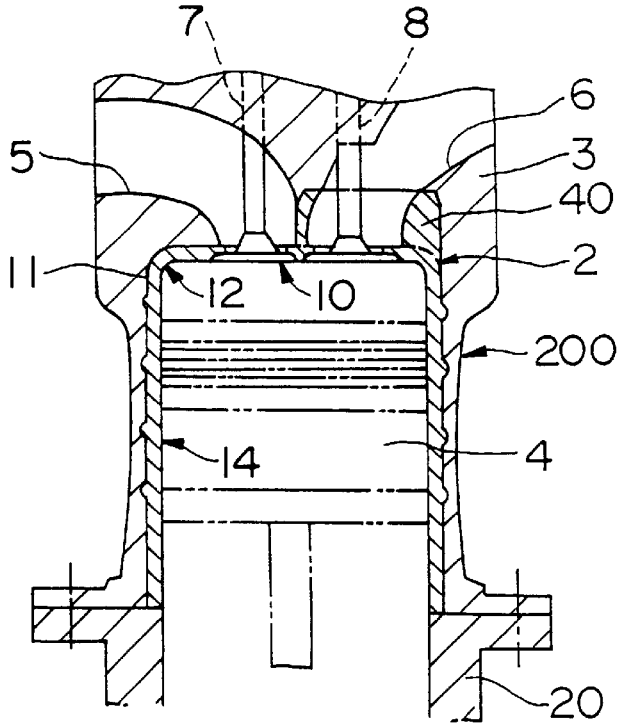
FIGS. 4(*a*) and 4(*b*) are explanatory views of an integral cylinder head according to an embodiment 3 of the invention.
Figure 4:
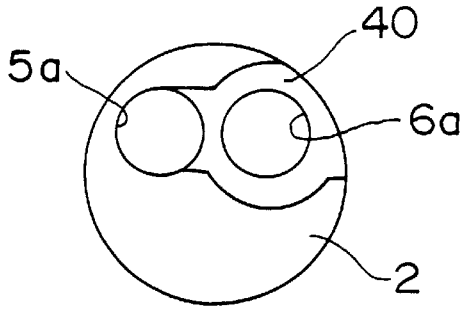

As shown in a vertical sectional view of FIG. 4(*a*) and a plan view of the top wall of FIG. 4(*b*), the cylinder head-integrated cylinder block 200 of the embodiment 3 has the protuberant portion 40 formed by forming a portion of an inner body of the exhaust port 6 surrounding the opening hole 6*a* into an annular projecting portion on the top wall face of the cup-shaped forged portion 2.

When high-temperature gas after combustion is exhausted, the opening hole 5*a* of the intake port 5 is closed by the intake valve 7, but the opening hole 6*a* of the exhaust port 6 is open. Therefore, the high-temperature gas after combustion is exhausted through the inner body of the exhaust port 6 surrounding the opening hole 6*a*. Because the inner body of the exhaust port 6 surrounding the opening hole 6*a* is a part exposed to the high-temperature gas after the combustion, the protuberant portion 40 is molded integrally with the cup-shaped forged portion 2 by using the aluminum forged member with the high-strength aluminum characteristic that is the same as the member used for the bottom portion 10 and the side portion 11 of the cup-shaped forged portion 2.

The cylinder head-integrated cylinder block 200 is formed by molding a periphery of the cup-shaped forged portion 2 having the protuberant portion 40 in the casting aluminum by enveloped casting.

According to the embodiment 3, the inner body portion of the exhaust port 6 which extends from the opening hole 6*a* to the exhaust port 6 and which is the most likely to be exposed to the combustion pressure and the combustion gas under the high temperature condition is reinforced by the protuberant portion 40. Therefore, the inner body portion can resist the combustion pressure and the combustion gas under the high temperature condition and the fatigue strength of the exhaust system is increased.

Although the combustion chamber 13 described in the above embodiments 1, 2, and 3 has a flat shape and the bottom portion 10 of the cup-shaped forged portion 2 has a flat shape to be adaptable to the combustion chamber 13, the shape of the bottom portion of the cup-shaped forged portion of the invention is not limited to the flat shape. In other words, the bottom portion of the cup-shaped forged portion of the invention is molded to have a shape adaptable to the shape of the combustion engine. If the combustion chamber has a hemispherical shape, the bottom portion is molded to have a hemispherical shape. If the combustion chamber has a wedge shape, the bottom portion is molded to have a pent roof shape.

<Embodiment 1 of Manufacturing Process>

Next, the embodiment of the manufacturing process of the cylinder head-integrated cylinder block according to the invention will be described.

Figure 5:
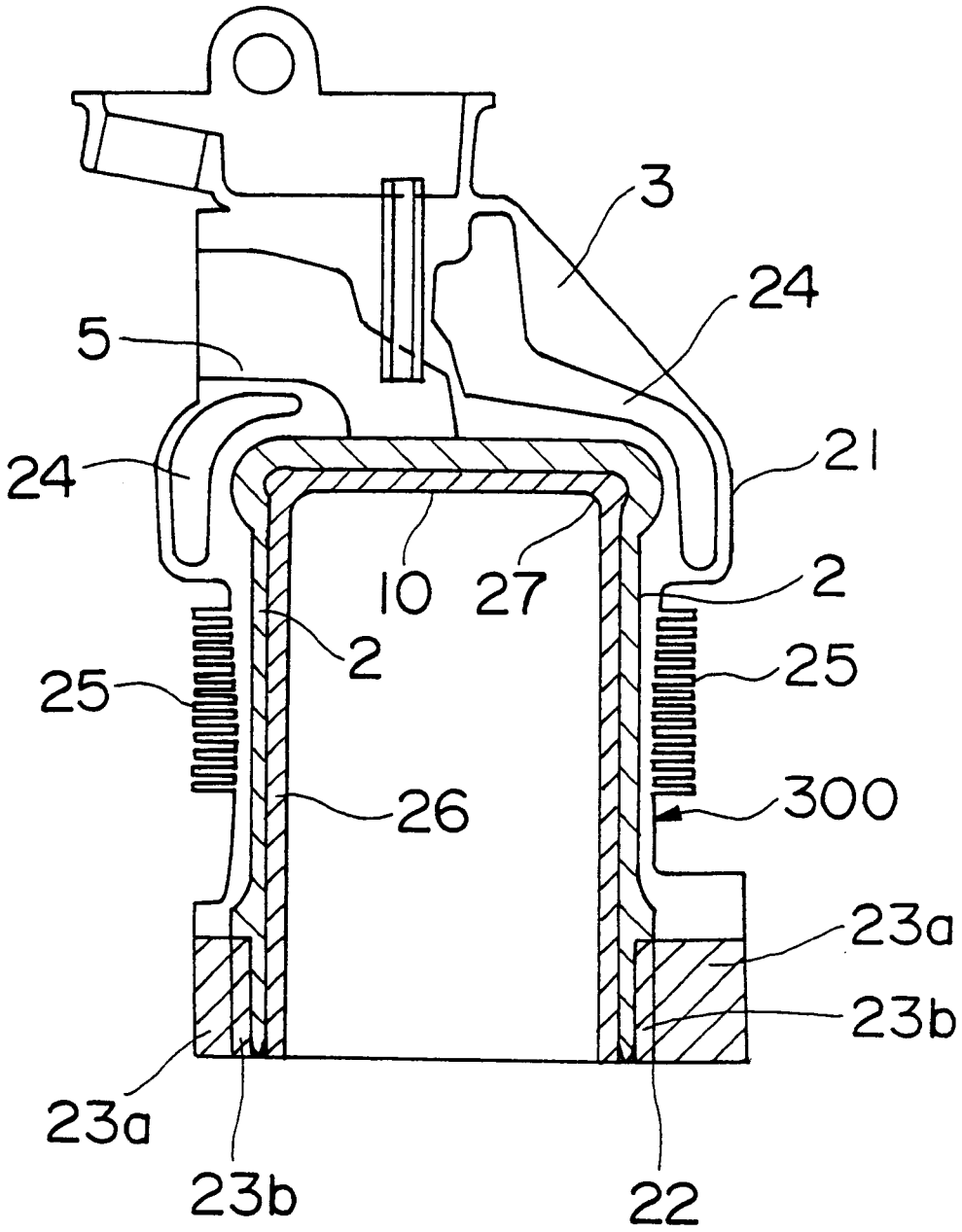
FIG. 5 is a sectional view showing an embodiment 1 of a manufacturing process of the invention.

First, in FIG. 5, a cylindrical cup-shaped member (cup-shaped forged portion 2) having a bottom is molded of reinforced aluminum material having heat resistance and wear resistance.

As described above, the reinforced aluminum material is formed based on the mixing ratio of the aluminum powder to the metallic additive. By mixing them and pouring the molten aluminum material into a casting die, the cup-shaped member is molded.

Next, the molded cup-shaped member 2 is put into a casting die and the molten casting aluminum material is teemed around the cup-shaped member 2 to molding the cup-shaped member 2 in a surrounding member 21 made of the casting aluminum member by enveloped casting.

Thus, the cylinder head portion (the bottom portion 10 and the side portion 11) and the cylinder block 300 are molded as an integral body.

The surrounding member 21 is formed with structures necessary for the internal combustion engine such as the intake port 5, the exhaust port (not shown), a water jacket 24, and a cooling fin 25.

Then, the cylinder block portion 300 in which the cup-shaped member 2 is molded by enveloped casting is put into a furnace with an upper limit of high temperature at which a material characteristic of the reinforced aluminum material constituting the cup-shaped member 2 does not change and maintained for a long time period under high pressure. For example, a pressure treatment is applied to the cylinder block portion 300 at a temperature around 450° C., under pressure of about 1000 kg/cm$^2$(98 MPa), and for about 1.5 hours. However, because raising of temperature, pressurization, cooling, and reducing of pressure are necessary before and after the 1.5 hours, one treatment requires at least a half day.

The pressure treatment is usually called HIP (Hot Isostatics Pressing). By this pressure treatment, bonding of the phase boundary between the cup-shaped member 2 made of the reinforced aluminum member and the surrounding member 21 made of the casting aluminum member is further ensured.

Before the pressure treatment, a joint face end portion 22 between the cup-shaped member 2 and the surrounding member 21 made of the casting aluminum material in which the cup-shaped member is molded by enveloped casting is welded.

Then, when the pressure treatment is finished, the welded joint face end portion is removed. The portion to be removed is provided with the reference numerals 23*a* and 23*b* in FIG. 5. The reference numeral 23*a* designates the portion of the surrounding member to be removed and the reference numeral 23*b* is the portion of the cup-shaped member 2 to be removed. Sizes of the cup-shaped member 2 and the casting die used for surrounding by the surrounding member are set at slightly larger values in advance to allow for sizes of the portions to be removed.

A thickness of the cup-shaped member 2 is set at a value larger than a required thickness of a final molded product by a predetermined value and an inner wall face of the cup-shaped member is removed after the pressure treatment until the final thickness is obtained. The portion to be removed is provided with the reference numeral 26 and is hatched.

Before the removal, the bottom portion corner portion 27 of the portion 26 to be removed of the cup-shaped member 2 is applied with a radiusing processing to have an arc shape such that the bottom corner portion 27 is not cracked when stress is applied to the bottom corner portion 27 in the pressure treatment.

Finally, a hole is formed in the bottom portion 10 of the cup-shaped member 2 such that the hole corresponds to the intake port 5 or the exhaust port. Similarly, holes are formed at portions where a fuel injection valve and a spark plug are to be mounted and the fuel injection valve and the spark plug are mounted to the holes.

<The Second Embodiment of Manufacturing Process>

Figure 6:
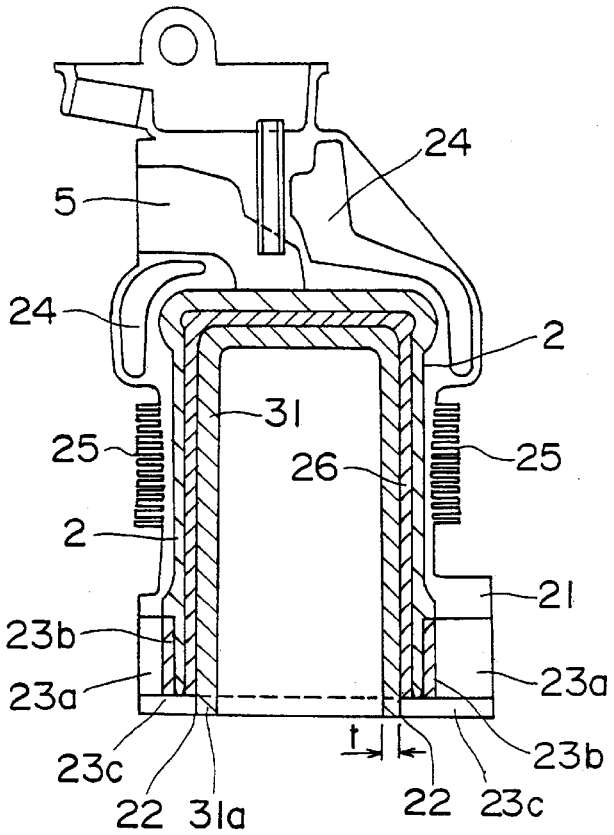
FIG. 6 is a sectional view showing an embodiment 2 of a manufacturing process of the invention.

Here, as shown in FIG. 6, by teeming into the cup-shaped member 2 formed as described above, a cup-shaped aluminum casting 31 with a predetermined thickness is formed. The thickness t of the inside cup-shaped aluminum casting 31 is determined by a size of a core inserted into the cup-shaped member 2 in teeming of the molten casting aluminum material into the cup-shaped member 2.

An opening side end portion 31*a* of the cup-shaped aluminum casting 31 is formed to project outward from an opening end edge of the cup-shaped member.

The cup-shaped member 2 having the inside aluminum casting 31 is molded in the surrounding member 21 made of the casting aluminum material by enveloped casting. High heat is transmitted to the cup-shaped member 2 in teeming of the surrounding member 21. However, there is the inside aluminum casting 31 inside the cup-shaped member 2 and therefore, the inside aluminum member absorbs heat in the teeming, thereby cooling the cup-shaped member 2.

In casting of the surrounding member 21, the surrounding member 21 is joined to the projecting opening side end portion 31*a* that is an end portion of the inside aluminum casting at an opening portion of the cup-shaped member 2.

Then, a jointed joint face end portion 22 is welded. After the welding, the above pressure treatment is applied, and finally, the welded portion 22 is removed.

A removal procedure will be described in detail. First, the welded portion 22 and the opening side end portion 23*c* of the surrounding member 21 including the opening side end portion 31*a* of the inside aluminum casting 31 are removed. Then, an opening side peripheral portion 23*a* of the surrounding member 22 is removed and an opening side peripheral portion 23*b* of the cup-shaped member is removed.

Then, a predetermined thickness of the inner wall face of the cup-shaped member including the inside aluminum casting 31 is removed until the final thickness is obtained.

Finally, a hole is formed in the bottom portion 10 of the cup-shaped member such that the hole corresponds to the intake port 5 or the exhaust port. Similarly, holes are formed at portions where the fuel injection valve and the spark plug are to be mounted and the fuel injection valve and the spark plug are mounted.

<The Third Embodiment of Manufacturing Process>

Figure 7:
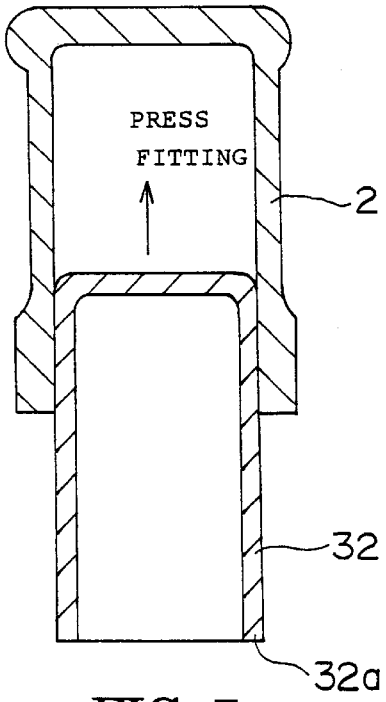
FIG. 7 is a sectional view showing an embodiment 3 of a manufacturing process of the invention.

As shown in FIG. 7, when the cup-shaped member 2 is assumed to be a first cup-shaped member in the second embodiment of the manufacturing process, a second cup-shaped member 32 that can be fitted into the first cup-shaped member is formed by casting by using the casting aluminum.

Then, the second cup-shaped member 32 is press-fitted into the first cup-shaped member. An opening side edge portion 32*a* of the second cup-shaped member 32 has such a size as to project outward from the opening end edge of the first cup-shaped member 2 when the second cup-shaped member 32 is fitted into the first cup-shaped member.

Then, the first cup-shaped member 2 is molded in the surrounding member 21 made of casting aluminum material by enveloped casting. At this time, the surrounding member on the opening portion side of the first cup-shaped member 2 is joined to the opening side edge portion 32*a* of the second cup-shaped member 32.

After the joined joint face end portion is welded, the above pressure treatment is applied. Finally, the welded portion is removed and the inner wall face of the first cup-shaped member 2 including the second cup-shaped member 32 is removed until the final thickness is obtained. The succeeding treatment including this point is the same as that in the above-described second embodiment of the manufacturing process, and therefore, description of it will be omitted.

<The Fourth Embodiment of Manufacturing Process>

Figure 8:
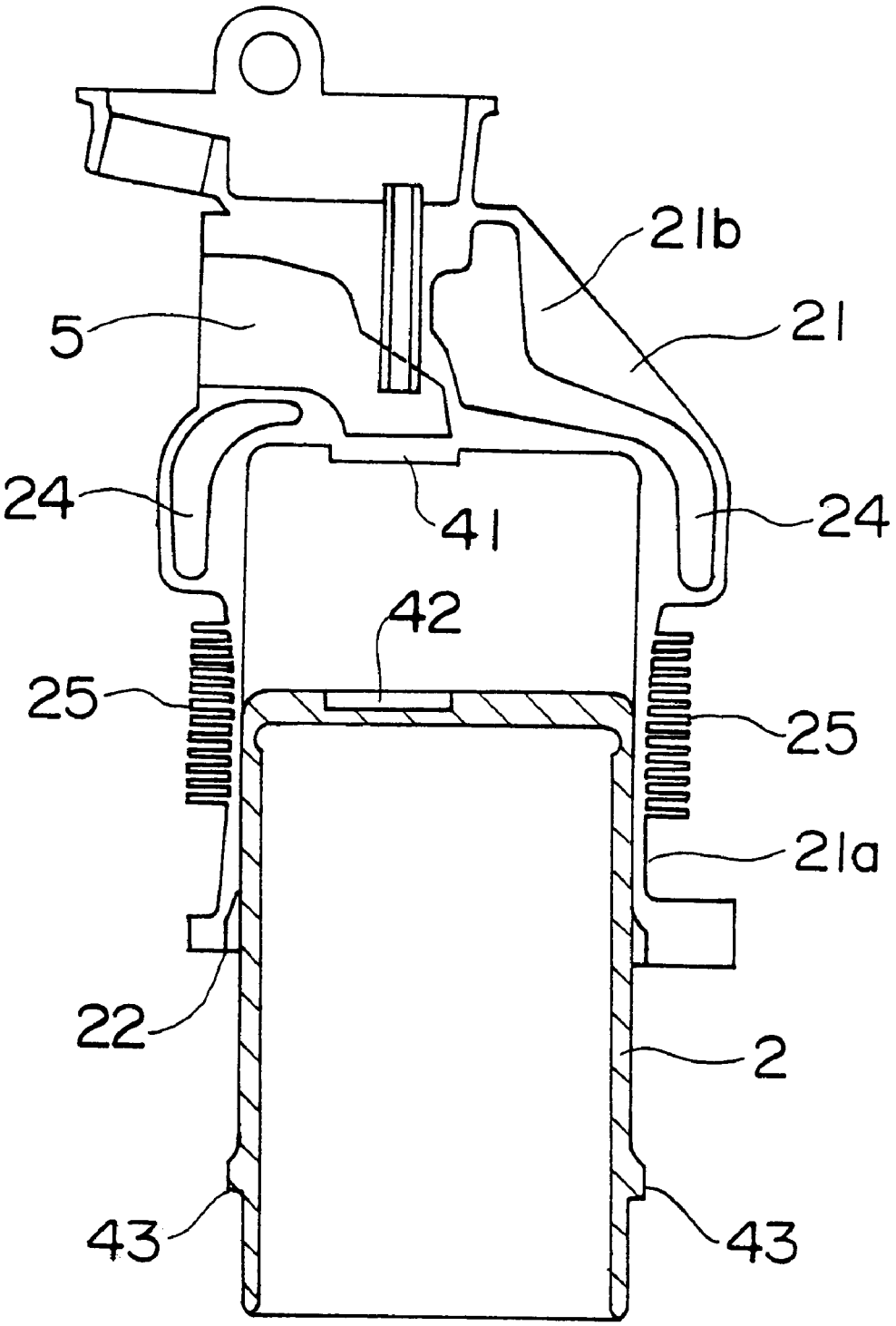
FIG. 8 is a sectional view showing an embodiment 4 of a manufacturing process of the invention.

As shown in FIG. 8, a cylindrical cylinder block portion 21*a* and a cylinder head portion 21*b* for closing one of the opening ends of the cylinder block portion are integrally molded of the casting aluminum material. This corresponds to the surrounding member 21 of the above respective embodiments. The cylinder head portion 21*b* is formed with the intake port 5 and the water jacket 24 and the cylinder block portion 21*a* is formed at an outer periphery thereof with the cooling fin 25. Circular projecting portions 41 that project slightly are formed at portions on an inner side of the cylinder head portion 21*b* to correspond to the intake port 5 and the exhaust port (not shown).

On the other hand, the cylindrical cup-shaped member 2 having the bottom and made of the reinforced aluminum material that is made to the above-described formula so as to have heat resistance and wear resistance is forged. The cup-shaped member has circular recessed portions 42 which correspond to the above circular projecting portions 41 and into which the circular projecting portions 41 are press-fitted, the circular recessed portions deviating on an outer face of the bottom portion of the cup-shaped member 2. An outer periphery of the cup-shaped member has a constant outer diameter such that the cup-shaped member has a straight shape. However, a projecting portion 43 to be fitted into an opening edge inner periphery of the cylinder block portion is formed on an outer periphery of the cup-shaped member in the vicinity of the opening edge.

The cup-shaped member formed in the above manner is press-fitted into the other opening end of the cylinder block portion. At this time, the circular projecting portions 41 formed on the inner bottom portion of the cylinder head portion 21*b* are press-fitted into the circular recessed portions 42 formed on the outer face of the bottom portion of the cup-shaped member. Because the circular projecting portions 41 and the circular recessed portions 42 are deviated, the cup-shaped member 2 is positioned with respect to the cylinder block portion such that the circular projecting portions 41 are aligned with the circular recessed portions 42 when the cup-shaped member 2 is press-fitted into the cylinder block portion 21*a*.

As a positioning means, it is preferable to form a projecting streak or a groove on the inner wall face of the cylinder block portion on the one hand and to form a groove or a projecting streak to be fitted over or into the above projecting streak or the groove on the outer wall face of the cup-shaped member on the other hand.

The cup-shaped member 2 and the surrounding member 21 are integrated with each other by press-fitting the cup-shaped member 2 into the cylinder block portion 21*a*. Therefore, after that, the integrated cup-shaped member 2 and surrounding member (the cylinder block portion and cylinder head portion) undergo the pressure treatment under a condition of a temperature at which the material characteristic of the reinforced aluminum material constituting the cup-shaped member 2 does not change.

Because specific conditions of the pressure treatment are the same as those described above, descriptions of them are omitted here.

Finally, holes are formed at portions corresponding to the intake port 5 and the exhaust port. In the case of FIG. 8, the holes are formed at portions of the circular projecting portions 41 and the circular recessed portions 42 which are fitted with each other. It is preferable that a diameter of each the hole is smaller than that of the circular projection and the circular recessed portion, because, in this case, a joint face between the cup-shaped member and the cylinder head portion and facing the intake port or the like forms a step in section to further reliably prevent exfoliation after the pressure treatment.

<Supplemental Explanation>

FIGS. 9 to 13 show a method for preventing exposure of the phase boundary commonly applied to the above respective manufacturing processes.

According to the structure of the invention, in any of the embodiments, the cup-shaped member 2 and the surrounding member 21 surrounding the cup-shaped member 2 are in close contact with each other under pressure by the pressure treatment.

In such a structure, the joint face (phase boundary) between the cup-shaped member 2 and the surrounding member 21 is exposed to an outside at an end portion of the joint face.

The exposed portions include a joint face end portion (portion B in FIG. 9) between the projecting portion formed at the outer periphery of the cup-shaped member in the vicinity of the opening edge and the opening edge of the surrounding member, a joint face (portion A in FIG. 9) between the intake port or the exhaust port and an inner peripheral face of the hole of the cup-shaped member where the inner peripheral face faces the intake port or the exhaust port, and a joint face (portion C in FIG. 12) between the cup-shaped member and the surrounding member at an inner peripheral face of the hole through which the fuel injection valve or the spark plug is mounted.

Treatment applied to the above exposed portions will be described below.

Figure 9:
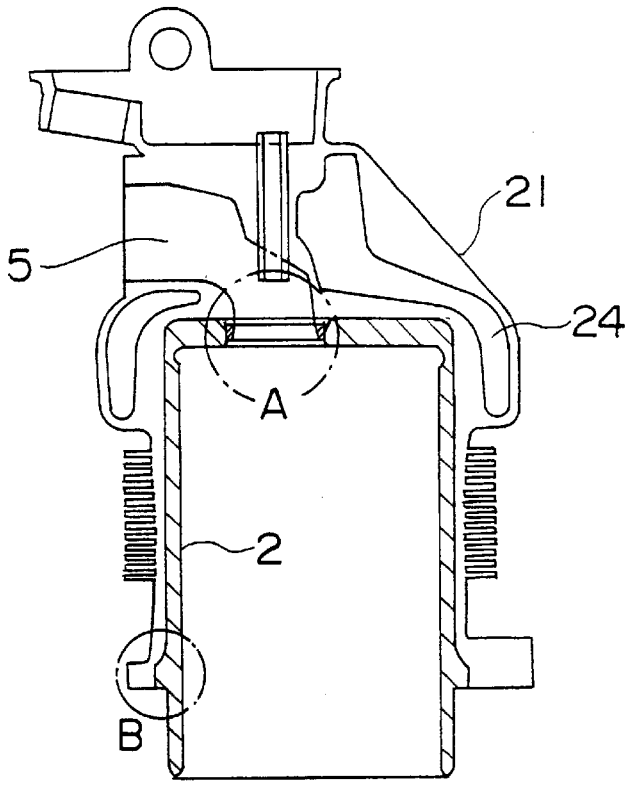
FIG. 9 is a sectional view showing a periphery of an intake port.
Figure 10:
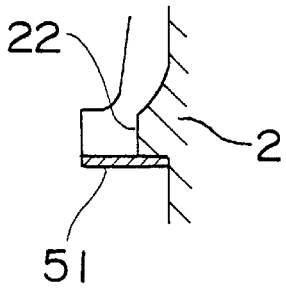
FIG. 10 is an enlarged sectional view showing details of a portion B in FIG. 9.

FIG. 10 shows treatment applied to the portion B in FIG. 9. Here, a method of coating the phase boundary with liquid gasket and a method of covering the phase boundary with a ring-shaped seal member 51 in a shape of a thin plate can be explained as examples. The liquid gasket is gasket that is liquid and set by drying after application of it as a coat.

Figure 11:
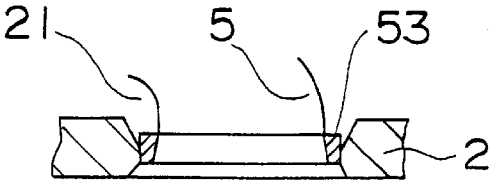
FIG. 11 is an enlarged sectional view showing details of a portion A in FIG. 9.

FIG. 11 shows treatment applied to the portion A in FIG. 9. Here, a ring-shaped valve seat 53 corresponding to the phase boundary is fitted into the hole portion.

Figure 12:
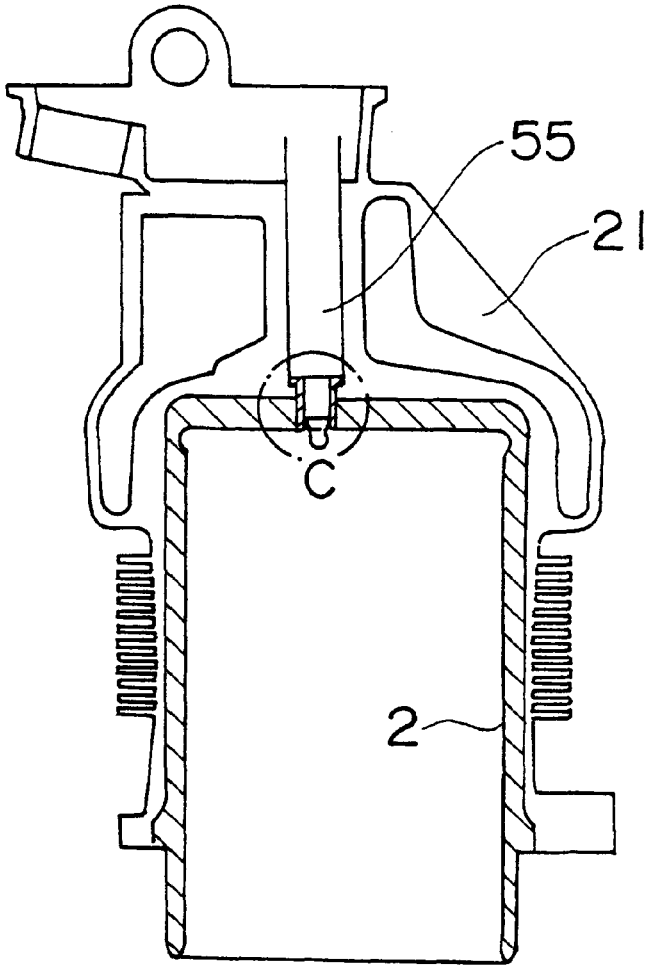
FIG. 12 is a sectional view including a periphery of a fuel injection valve.
Figure 13:
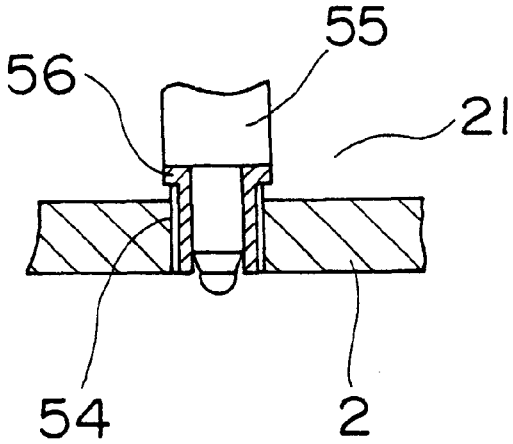
FIG. 13 is an enlarged sectional view showing details of a portion C of FIG. 12.

FIG. 13 shows treatment applied to the portion C in FIG. 12. Here, a cylindrical seal member 54 is fitted into the inner periphery of the hole through which the fuel injection valve or the spark plug is mounted and the phase boundary is covered with the cylindrical seal member 54. The fuel injection valve 55 or the spark plug is press-fitted or engaged by screwing into the hole portion through the cylindrical seal member 54. A threaded portion 56 formed on an outer periphery of the fuel injection valve 55 or the spark plug is shown in FIG. 13.

By covering the above each exposed portion of the phase boundary with the seal material or the like, it is possible to prevent exfoliation of the phase boundary due to any stress generated in operation of the engine.

<Another Example of Manufacturing Process>

Next, an example of manufacturing in which the cylindrical cup-shaped member 2 having the bottom is molded in the casting aluminum material (surrounding member 21) by enveloped casting to mold the cylinder head portion and the cylinder block portion as an integral body will be described in the following supplemental explanation by using FIGS. 14 to 21.

Figure 17:
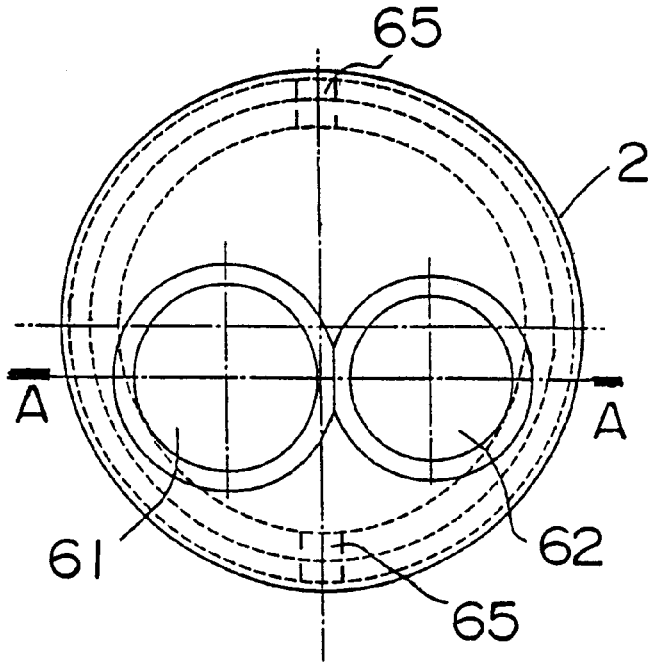
FIG. 17 is a bottom view of the cup-shaped member and shows recessed portions corresponding to intake and exhaust ports.
Figure 18:
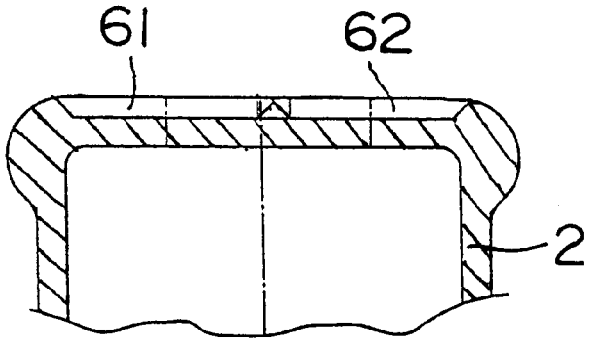
FIG. 18 is a sectional view taken along a line A—A in FIG. 17.

On an outer face of the bottom portion of the cup-shaped member 2 that will be the cylinder liner, recessed portions 61 and 62 corresponding to the exhaust port and the intake port are formed as shown in FIGS. 17 and 18.

A reason for forming the recessed portions 61 and 62 is as follows.

Figure 19:
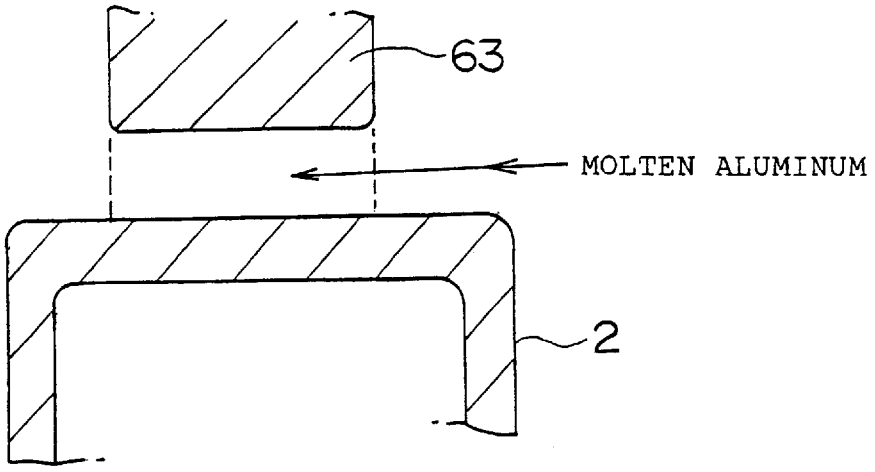
FIG. 19 shows a case of molding a port by using a core.

In a case of molding the cup-shaped member 2 in the casting aluminum member 21 by enveloped casting, it is necessary to set cores 63 for forming the exhaust port and the intake port in a casting die as shown in FIG. 19. In setting of these cores, if an end face of each the core 63 is brought into contact with an outer bottom face of the cup-shaped member 2 and the aluminum member that will be the surrounding member 21 is teemed, there is a possibility that the aluminum member exfoliates from the phase boundary between the cup-shaped member 2 and the surrounding member 21 in the pressure treatment after the casting.

Therefore, it is preferable not to bring each the core 63 into contact with the outer bottom face of the cup-shaped member 2 but to set the core 63 with a certain degree of distance between the core 63 and the outer bottom face.

In such a case, the aluminum member at the position corresponding to each the core is cut and removed to complete the exhaust or intake port.

It is necessary to form a portion of the exhaust or intake port, especially the intake port, close to an inside of the cylinder into a shape of a complicated curved surface so as to generate swirl flow. It is difficult to form such a shape by machining in many cases where processing accuracy is considered. It is easier to form such a shape of the curved surface by using the core 63.

Figure 20:
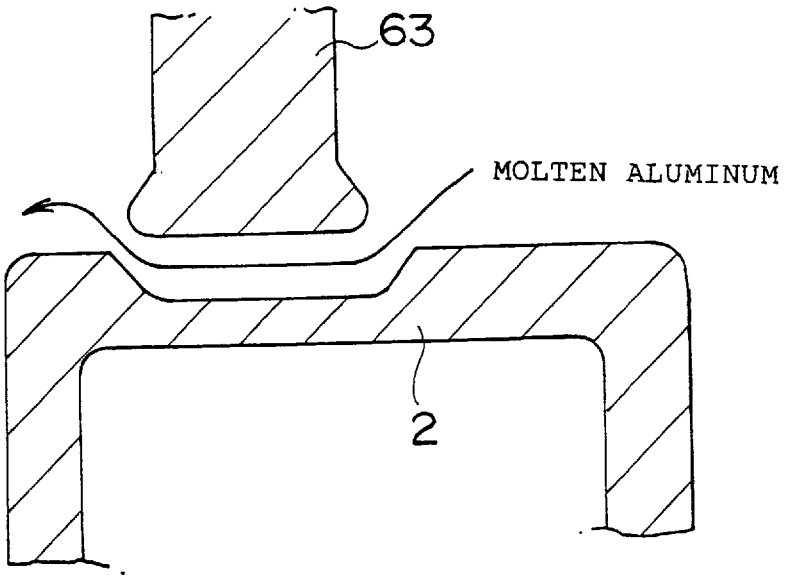
FIG. 20 shows a relationship between positions of the core and a recessed portion.

In order to increase an amount of the port portion formed by each the core 63 and not to bring each the core 63 into contact with the outer bottom face of the cup-shaped member 2 to allow molten aluminum to flow, it is preferable to reduce a thickness of the cup-shaped member. Therefore, the recessed portions 61 and 62 corresponding to the ports are formed as shown in FIGS. 17 and 18. In this manner, it is possible to form greater parts of the intake and exhaust ports by using the cores 63 and to form sufficient gaps to allow the teemed molten aluminum member to flow through between the cores 63 and the cup-shaped member 2 as shown in FIG. 20.

If the recessed portions 61 and 62 are formed in this manner, it is necessary to position the cup-shaped member 2 in a rotating direction around a central axis of the cup-shaped member 2 in setting the cup-shaped member 2 in the casting die for enveloped casting so as to align the cup-shaped member 2 with a shape of the die.

Figure 15:
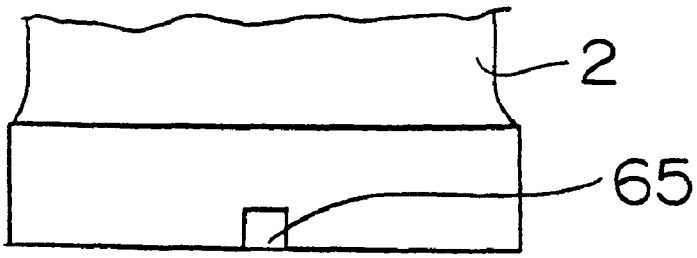
FIG. 15 is a side view of a portion of a cup-shaped member showing a notch for positioning.
Figure 16:
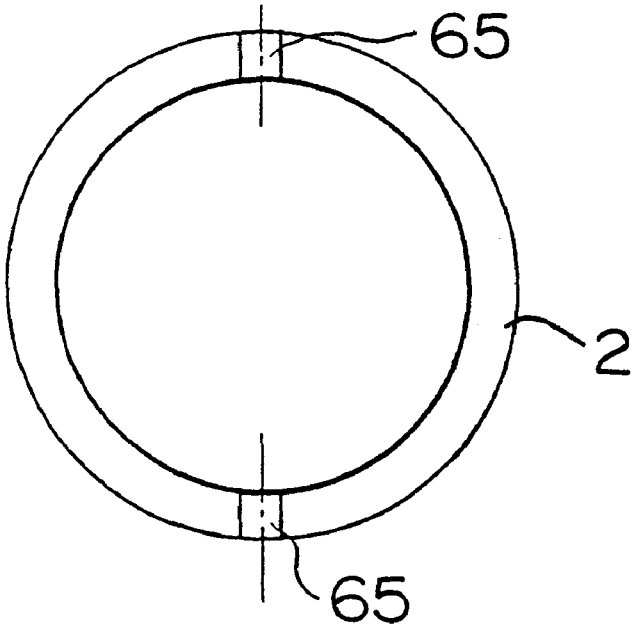
FIG. 16 shows an opening end face of the cup-shaped member showing the notches for positioning.

Therefore, in the present embodiment, a notch 65 is formed at least at one position, and here at two positions at intervals through 180° as shown in FIG. 16, on an open end of the cup-shaped member 2 as a positioning portion for positioning as shown in FIGS. 15 and 16.

The notch portions 65 may be molded integrally in molding of the cup-shaped member 2 or may be formed mechanically by cutting processing after the molding.

Figure 21:
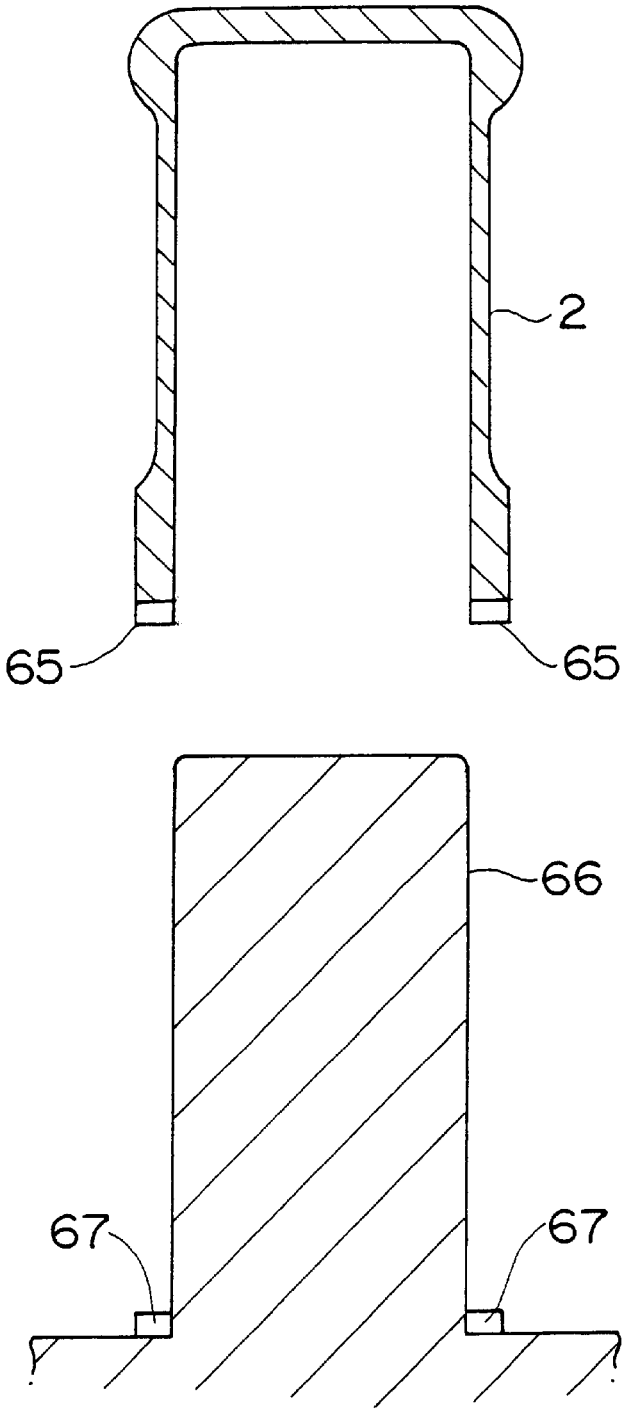
FIG. 21 shows an example of positioning.

In setting the cup-shaped member 2 in the above casting die, the cup-shaped member is set on a jig 66 for retaining and constituting a portion of the casting die and is caused to rotate around the jig as shown in FIG. 21. The jig 66 is formed at a base portion thereof with engaging projections 67 as engaging portions to be engaged with the notches 65 of the cup-shaped member.

When the notches 65 of the rotating cup-shaped member and the engaging projections 67 are engaged with each other, the cup-shaped member 2 does not rotate any more where the cupshaped member 2 is positioned.

Figure 14:
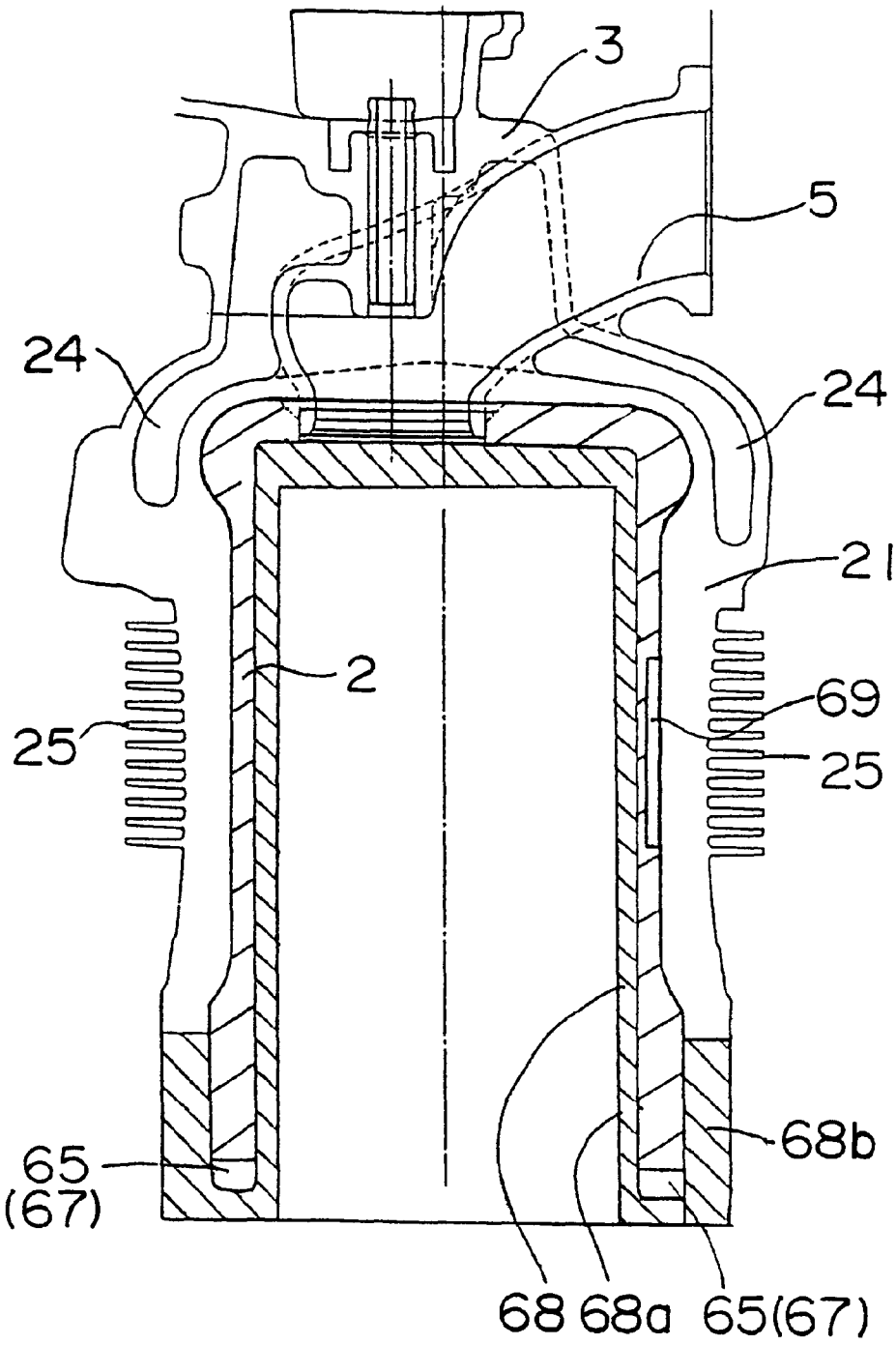
FIG. 14 is a diagrammatic illustration of a case in which positioning is carried out.
Figure 22:
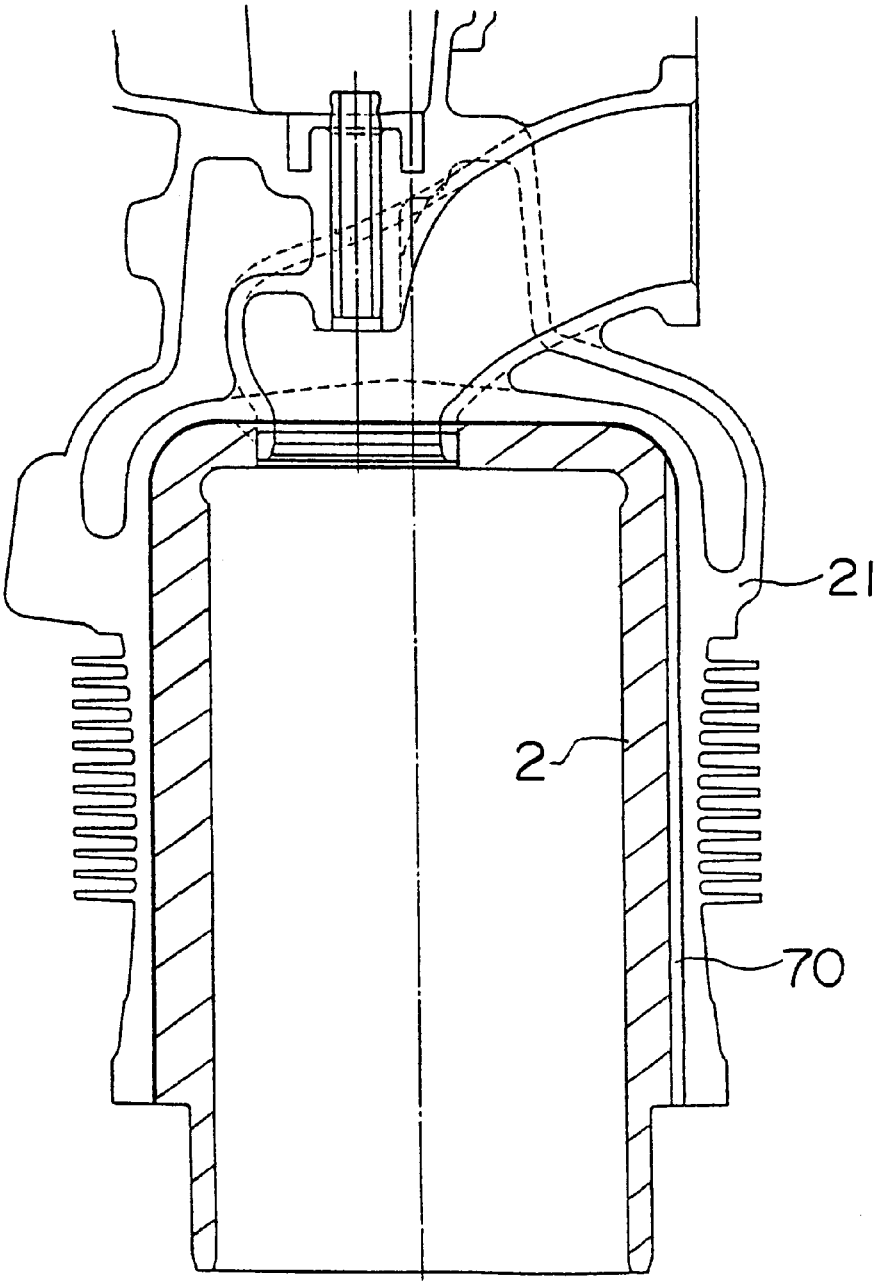
FIG. 22 is a diagrammatic illustration of a case in which a groove for venting air is provided to the cup-shaped member.

In the example shown in FIG. 14, a positioning plate 68 is set in a casting die (not shown) instead of the jig shown in FIG. 22.

The positioning plate 68 has an inside fitting portion 68*a* to be fitted with an inside of the cup-shaped member 2 and an outside fitting portion 68*b* wrapped around an outside of the opening edge of the cup-shaped member 2 and the engaging projections 67 to be fitted into the notches 65 of the cup-shaped member 2 are formed between the inside fitting portion 68*a* and the outside fitting portion 68*b*. The positioning plate 68 also functions as the second cup-shaped member 32 shown in FIG. 7 of the third embodiment of the manufacturing process.

A groove 69 is formed on an outer peripheral face of the cup-shaped member 2 by machining. It is possible to judge if the pressure treatment was carried out properly based on if the aluminum member constituting the surrounding member 21 is fused into the groove 69. This judgment is preferably carried out by a nondestructive inspection such as a CT scan. If the aluminum member constituting the surrounding member 21 is fused into the groove 69, it is judged that the pressure treatment was conducted properly.

When the positioning of the cup-shaped member 2 is completed, the casting die for molding the surrounding member 21 is laid over the cup-shaped member 2 and the molten aluminum member is teemed to mold the surrounding member 21.

After molding of the surrounding member 21, the joint face end portion between the surrounding member 21 and the outside fitting portion 68*b* of the positioning plate 68 is welded. Then, the pressure treatment is applied, the opening edge side of the cup-shaped member 2 is removed, and the inner wall face of the cup-shaped member as well as the positioning plate is removed until the final thickness is obtained.

Operation of this portion is similar to that of the third embodiment of the manufacturing process and description of the portion will be omitted.

Although two positioning notches 65 are formed in FIG. 16, it is possible to carry out the positioning by changing shapes and sizes of the respective notches and phase of the positions where the notches are formed in such a case.

It is possible to similarly carry out the positioning when one notch 65 is formed.

If the cup-shaped member 2 is press-fitted through the other opening end of the cylinder block portion 21*a* as in the fourth embodiment of the manufacturing process, it is preferable to form a groove 70 extending in a direction of a cylinder axis on at least one of an outer peripheral face of the cup-shaped member 2 and an inner peripheral face of the cylinder block portion 21*a* so as to let air in the cylinder block portion 21*a* escape as shown in FIG. 22. In this example, the groove 70 is formed only on the outer peripheral face of the cup-shaped member 2.

Figure 23:
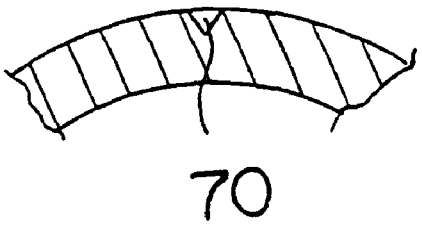
FIG. 23 shows an example of a sectional shape of the groove.
Figure 24:
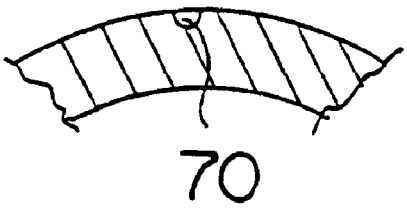
FIG. 24 shows another example of a sectional shape of the groove.

The groove may have a rectangular shape or other shapes in section in addition to a V shape or a semicircular shape as shown in FIGS. 22 and 23. A volume of the groove is set at such a value that a part of the aluminum member constituting the surrounding member can be fused into the groove in the pressure treatment.

As a result, compressed air escapes to an outside through the groove 70 in press-fitting of the cup-shaped member 2 into the surrounding member 21, thereby increasing a degree of close contact between the surrounding member 21 and the cup-shaped member 2.

Moreover, it is possible to judge if the pressure treatment was carried out properly based on if the aluminum member constituting the surrounding member 21 is fused into the groove 70. This is preferably carried out by the nondestructive inspection such as the CT scan. If the aluminum member constituting the surrounding member 21 is fused into the groove 70, it is judged that the pressure treatment was carried out properly.

If the groove 70 is formed throughout a substantially total length of the cup-shaped member, a degree of freedom of an inspection range is increased and time required for the inspection can be shortened.

According to the present invention, because the head inner wall portion and the liner portion are integrally molded of the reinforced aluminum member as the cylindrical cup-shaped member having the bottom, the thickness of the wall may be decreased to reduce weight as compared with a case in which the cylinder head and the cylinder block are merely molded integrally by the aluminum casting method. Because the cylinder head and the cylinder block are molded integrally by molding the cylindrical reinforced aluminum member which has the bottom and is the cup-shaped member in the surrounding member by enveloped casting, the gas seal becomes unnecessary, thereby decreasing the number of parts and facilitating assembly.

It is possible to provide different characteristics to different parts of the integral body, i.e., provide the high-strength aluminum characteristic to the head inner wall portion and the wear-resistant aluminum characteristic to the liner portion and to obtain different types of performance required of the parts of the cylinder in the integral cylinder block.

According to the manufacturing process of the invention, it is possible to easily form the cylinder block portion integral with the cylinder head portion. Moreover, because the cylinder block portion in which the cup-shaped member is molded by the enveloped casting is pressurized under the condition of a temperature at which the material characteristic of the reinforced aluminum material constituting the cup-shaped member does not change, bonding strength between the cup-shaped member and the cylinder block portion is increased.

By welding the joint face end portion between the cup-shaped member and the casting aluminum material in which the cup-shaped member is molded by enveloped casting before pressurization, exfoliation at the joint face end portion due to pressurization can be prevented.

Because the welded portion is removed after welding and pressurization, the joint face end portion can be finished satisfactory.

Furthermore, if the joint face end portion after removal of the welded portion is covered with the seal member such as the valve seat, it is possible to prevent entrance of stress or the like from the joint face end portion and exfoliation of the joint face.

By setting the thickness of the cup-shaped member at a value larger than the thickness of the final molded product by a predetermined value and removing the inner wall face of the cup-shaped member until the final thickness is obtained, it is possible to carry out finishing with accurate dimensions as a whole.

If the cup-shaped aluminum casting with the predetermined thickness is formed inside the cup-shaped member and the cup-shaped member with the inside aluminum casting is molded in the surrounding member made of the casting aluminum material by enveloped casting, the inside aluminum casting cools the cup-shaped member to decrease a temperature of the liner portion in teeming of the surrounding member. Therefore, it is easy to maintain the required aluminum characteristic of the liner portion.

At this time, if the surrounding member is joined to the end portion of the inside aluminum casting at the opening portion of the cup-shaped member, the entire cup-shaped member made of the reinforced aluminum material is wrapped from inside and outside in the casting aluminum. Especially at the joint face end portion between the cup-shaped member and the surrounding member around the cup-shaped member, because the casting aluminum material on the inside and outside of the cup-shaped member is joined to protect the joint face end portion, it is possible to effectively prevent exfoliation of the joint face in the pressure treatment.

If the second cup-shaped member is fitted with the inside of the cup-shaped member, it is similarly possible to cool the cup-shaped member by the second cup-shaped member in teeming of the surrounding member, thereby maintaining the aluminum characteristic.

At this time, the surrounding member may be joined to the end portion of the second cup-shaped member at the opening portion of the first cup-shaped member, then, the pressure treatment may be applied after welding the joined joint face end portion, and finally, the welded portion may be removed and the inner wall face of the first cup-shaped member as well as the second cup-shaped member may be removed until the final thickness is obtained.

In this case, similarly to the previous method, it is possible to effectively prevent exfoliation of the joint face between the first cup-shaped member and the surrounding member in the pressure treatment.

Effects similar to the above case can be also exhibited in a case in which the surrounding member and the cup-shaped member are separately manufactured, the cup-shaped member constituting the surrounding member is press-fitted from the other opening end of the cylinder block portion, and the cup-shaped member and the cylinder block portion integrated in this manner are pressurized under the condition of the temperature at which the material characteristic of the reinforced aluminum material constituting the cup-shaped member does not change.

If positioning of the cup-shaped member is necessary, the positioning portions are formed at the open end portion of the cup-shaped member, thereby facilitating the positioning.

Furthermore, if the groove extending in the direction of the cylinder axis is formed on one of the outer peripheral face of the cup-shaped member and the inner peripheral face of the cylinder block portion, the compressed air can be easily vented to facilitate press-fitting in press-fitting the cup-shaped member into the cylinder block portion.

What is claimed is:

1. A cylinder head-integrated cylinder block, a cylinder head portion having an intake port and an exhaust port and a cylinder block portion whose end face opening is closed by said cylinder head portion being molded integrally by casting;

comprising a cylindrical cup-shaped member having a bottom and integrally molded of reinforced aluminum members having heat resistance and wear resistance for forming a head inner wall portion forming a combustion chamber and a liner portion which is adjacent to said head inner wall portion and against which a piston can slide, and said cylinder head-integrated block comprising a surrounding member formed of a casting aluminum member by casting such that said cup-shaped member is wrapped in said surrounding member.

2. A cylinder head-integrated cylinder block according to claim 1, wherein said reinforced aluminum member constituting said cup-shaped member has different aluminum characteristics at said head inner wall portion and said liner portion.

3. A cylinder head-integrated cylinder block according to claim 2, wherein said head inner wall portion is molded of an aluminum forged member with a high-strength aluminum characteristic and said liner portion is molded of an aluminum forged member with a wear-resistant aluminum characteristic.

4. A cylinder head-integrated cylinder block according to claim 1, wherein a corner portion where a bottom portion and an inner peripheral face portion at a periphery of said bottom portion of said cylindrical shape with said bottom of said head inner wall portion intersecting each other is formed into an arc shape.

5. An integral cylinder head of an internal combustion engine according to claim 1, wherein a projection and a depression are formed on an outer wall face of said reinforced aluminum member constituting said cylindrical cup-shaped member having said bottom and molded in said casting aluminum by enveloped casting.

6. A cylinder head-integrated cylinder block according to claim 1, wherein a protuberant portion made of the same reinforced aluminum member as that of said cup-shaped member is formed integrally to correspond to said exhaust port on a top wall face of said cylindrical cup-shaped member having said bottom and molded in said casting aluminum by enveloped casting and said exhaust port is formed to pass through said protuberant portion, thereby forming at least a portion of an inner wall of said exhaust port of said reinforced aluminum member.

7. A cylinder head-integrated cylinder block according to claim 1, wherein said liner portion has such an axial length as to allow said piston to slide to reciprocate between said combustion chamber side and a bottom dead center position.

8. A cylinder head-integrated cylinder block according to claim 1, wherein a joint face end portion between said cup-shaped member made of said reinforced aluminum member and said surrounding member which is made of said casting aluminum member and in which said cup-shaped member is wrapped is covered with a seal member.

9. A cylinder head-integrated cylinder block according to claim 8, wherein said joint face end portion between said cup-shaped member and said surrounding member is exposed when said intake port and said exhaust port are formed to pass through said cup-shaped member made of said reinforced aluminum member and said surrounding member which is made of said casting aluminum member and in which said cup-shaped member is wrapped, and is covered with said seal member.

* * * * *